US005288062A

United States Patent [19]

Rizzolo et al.

[11] Patent Number: 5,288,062

[45] Date of Patent: Feb. 22, 1994

[54] HIGH CAPACITY COMPILER WITH VERTICALLY ADJUSTABLE SHEET DISCHARGE AND ACQUIRE MEANS

[75] Inventors: Charles D. Rizzolo, Rochester; Barry P. Mandel, Penfield; Joseph J. Ferrara; Anthony T. DeSanctis, both of Webster, all of N.Y.; Peter A. Mayfield, Hemel Hempstead, England; Brian Whaites, Welwyn Garden City, England; Jeffrey W. Ryan, Herts, England

[73] Assignee: Xerox Corporation, Stamford, Conn.

[21] Appl. No.: 888,091

[22] Filed: May 26, 1992

[51] Int. Cl.[5] ..... B42B 2/00; B65H 31/26; B65H 5/02

[52] U.S. Cl. ..... 270/53; 271/220; 271/272; 271/902; 414/788.9; 414/795

[58] Field of Search ..... 270/52, 53, 58; 271/81, 271/200, 207, 213, 217, 215, 221, 223; 414/788.9, 789.9, 790.2, 793.8, 794.6

[56] References Cited

U.S. PATENT DOCUMENTS

| | | | |
|---|---|---|---|
| 3,208,745 | 9/1965 | March | 270/58 |
| 4,078,790 | 3/1978 | Stocker | 271/213 |
| 4,322,068 | 3/1982 | Cayn et al. | 271/207 |
| 4,322,069 | 3/1982 | Mitchell | 271/200 |
| 4,329,046 | 5/1982 | Burkett et al. | 355/321 |
| 4,350,333 | 9/1982 | Landa | 271/217 |
| 4,455,115 | 6/1984 | Alger et al. | 271/217 X |
| 4,548,399 | 10/1985 | Heider et al. | 271/221 |
| 4,776,578 | 10/1988 | Hirakawa et al. | 271/223 |
| 4,826,383 | 5/1989 | Millen | 414/789.9 |
| 4,844,440 | 7/1989 | Gray | 271/221 X |
| 4,883,265 | 11/1989 | Iida et al. | 271/220 |
| 4,927,131 | 5/1990 | Hashimoto et al. | 271/217 X |
| 4,958,827 | 9/1990 | Kaneko | 271/176 |
| 5,032,876 | 7/1991 | Murakami | 355/322 |
| 5,072,290 | 12/1991 | Kubota et al. | 271/221 X |
| 5,101,241 | 3/1992 | Watanabe | 271/200 |

FOREIGN PATENT DOCUMENTS

| | | | |
|---|---|---|---|
| 72568 | 5/1982 | Japan | 270/31 |

*Primary Examiner*—Edward K. Look
*Assistant Examiner*—John Ryznic
*Attorney, Agent, or Firm*—Kevin R. Kepnec

[57] ABSTRACT

An apparatus for stacking, registering and attaching one or multiple sets of electrophotographic printing machine output. The copy sheets are discharged from the machine and fall into an inclined compiling tray and are longitudinally registered by flexible, endless belts contacting the top surface of each sheet. Each sheet is then laterally shifted by a tamping mechanism which has upwardly flared baffle to corrugate the sheet as it is shifted to increase the sheet beam strength and facilitate easier and more complete registration. The discharge nip assembly which includes the flexible belts is vertically adjustable either based on discharged sheet count or in response to feedback from a stack height sensor so as to maintain optimum contact by the endless registration belt and allow for high capacity compiling. The compiling tray can also be adjustable. Once a complete set of sheets has been discharged and fully registered the stack is then attached by stapling or other means and is discharged from the compiling tray. The discharge nip and compiling tray then return to their home position to accept the next set of copy sheets.

18 Claims, 8 Drawing Sheets

HIGH CAPACITY COMPILER WITH VERTICALLY ADJUSTABLE SHEET DISCHARGE AND ACQUIRE MEANS

This invention relates generally to a finishing station of an electrophotographic printing machine, and more particularly concerns a sheet compiler used therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attached from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, it is often desirable to stack the discharged copy sheets, numbering from two sheets up to a large number of sheets, in sets with very close stack registration so as to avoid a ragged or uneven looking stack edge in finished, bound or stapled copy sets. It is further desirable when stapling or binding a set of sheets to locate or move the registered stack to a position at which the stapling or binding device can act upon the stack without disturbing the stack registration. It is also desirable to be able to stack and register copy sheet sets rapidly so as to not interrupt the output of the printing machine. It is also advantageous to be able to accommodate a wide range of stack heights and to be able to compile large sets or stacks of sheets. It is further advantageous to be able to compile and stack a wide range of paper sheet sizes and weights and/or stiffnesses without damage to the edges of the sheets or image smearing or other damage to the copies.

The following disclosures may be relevant to various aspects of the present invention:

U.S. Pat. No. 5,005,821; Patentee—Burger; Issue Date—Apr. 9, 1991.

U.S. Pat. No. 4,883,265; Patentee—Iida, et al.; Issue Date—Nov. 28, 1989.

EP-A-0 346 851 A1; Applicant—Masakazu; Publication Date—Dec. 20, 1989.

U.S. Pat. No. 4,605,211; Patentee—Sonobe; Issue Date—Aug. 12, 1986.

U.S. Pat. No. 5,044,625; Patentee—Reid; Issue Date—Sep. 3, 1991.

The relevant portions of the foregoing disclosures may be briefly summarized as follows:

U.S. Pat. No. 5,005,821 discloses a sheet stacking assistance and control system which comprises an endless, weighted, chain-like, loose element member. The beaded chain portion continuously lies on a top sheet of a stack and continuously drags it towards the registration position.

U.S. Pat. No. 4,883,265 discloses a stacking apparatus comprised of an endless web which is contactable to the top surface of a discharged sheet. The web, which may be an endless belt, rotates so as to displace the sheet until it abuts a registration edge or stopper disposed adjacent to the discharge outlet of the device.

EP-A-0 346 851 A1 describes a discharge sheet stack compiler and registration device which utilizes endless belts for both end registration and as a lateral registration device. The sheets are discharged and compiled in a fixed tray and after compiling and stapling, are further discharged to a catch tray.

U.S. Pat. No. 4,605,211 describes a discharge sheet compiling tray which collects the discharged copy sheets and aligns said sheets gravitationally until the set is complete. After binding the completed set, it is then discharged from the catch tray by a rocking type motion.

U.S. Pat. No. 5,044,625 discloses a lateral tamping device which utilizes a flapper arm or flag rotating about a fixed point to laterally align discharged copy sheets in various sorter bins.

In accordance with one aspect of the present invention, there is provided an apparatus for compiling a plurality of sheets received from a printing machine to form a stack thereof. The apparatus comprises means for acquiring and discharging sheets. There is further provided sheet compiling means disposed adjacent to the sheet acquiring and discharging means for receiving sheets from the sheet acquiring and discharging means. Means for detecting the height of the sheets in the sheet compiling means and means, responsive to the height detecting means for effecting displacement of said sheet longitudinal registration means relative to said sheet compiling means are also provided.

Other features of the present invention will become apparent as the following description proceeds and upon reference to the drawings, in which.

Figure 4A:
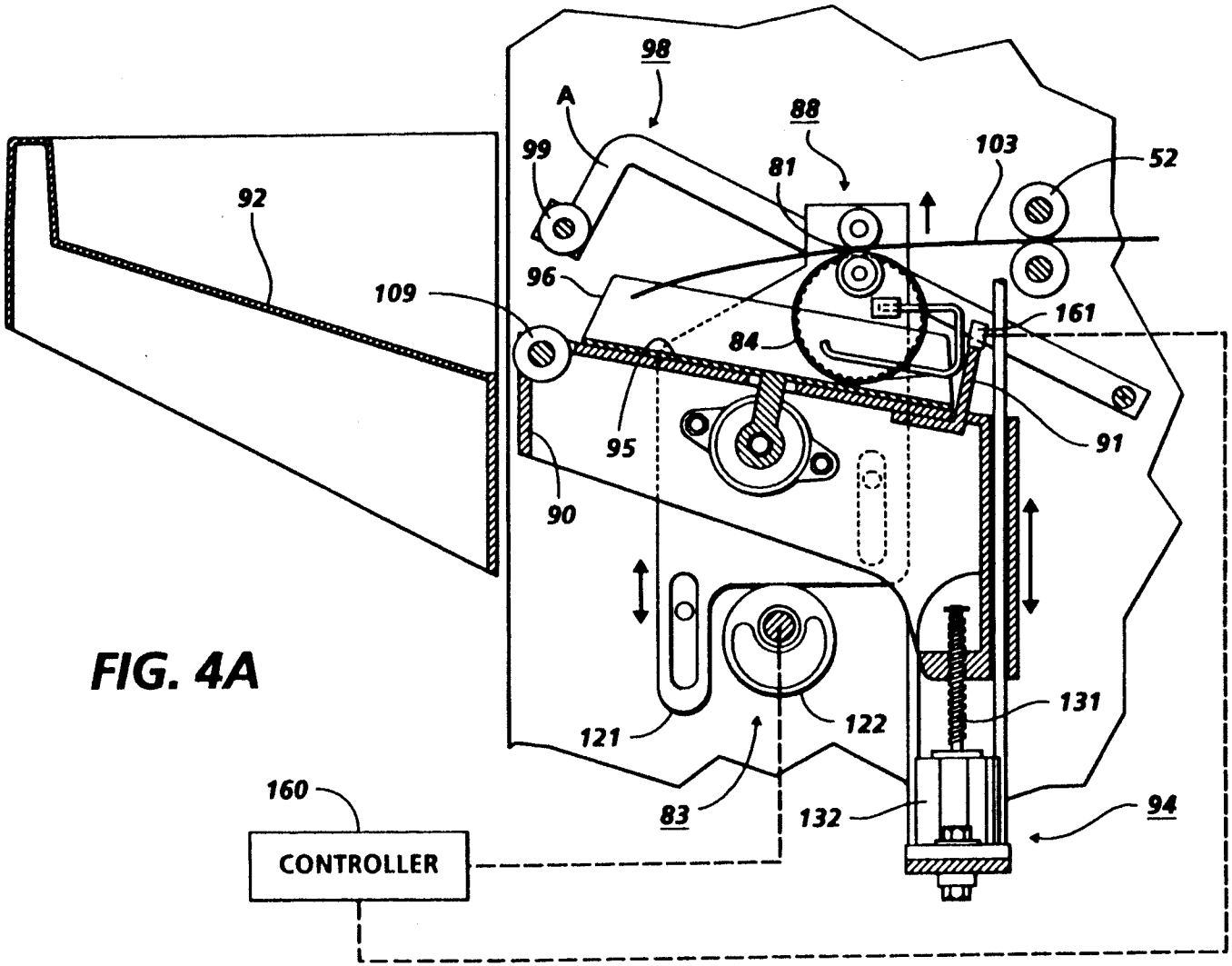
Figure 4B:
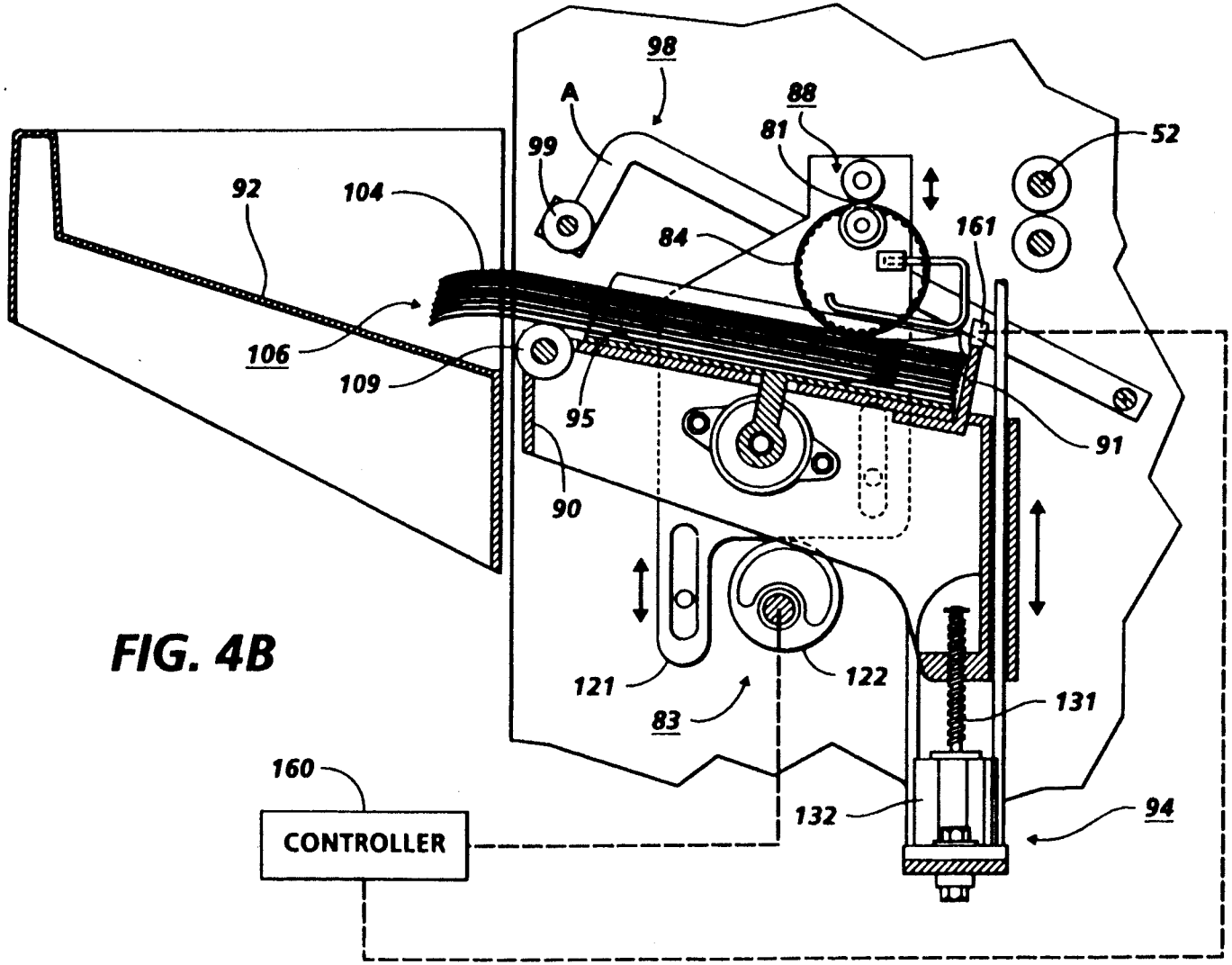
Figure 4C:
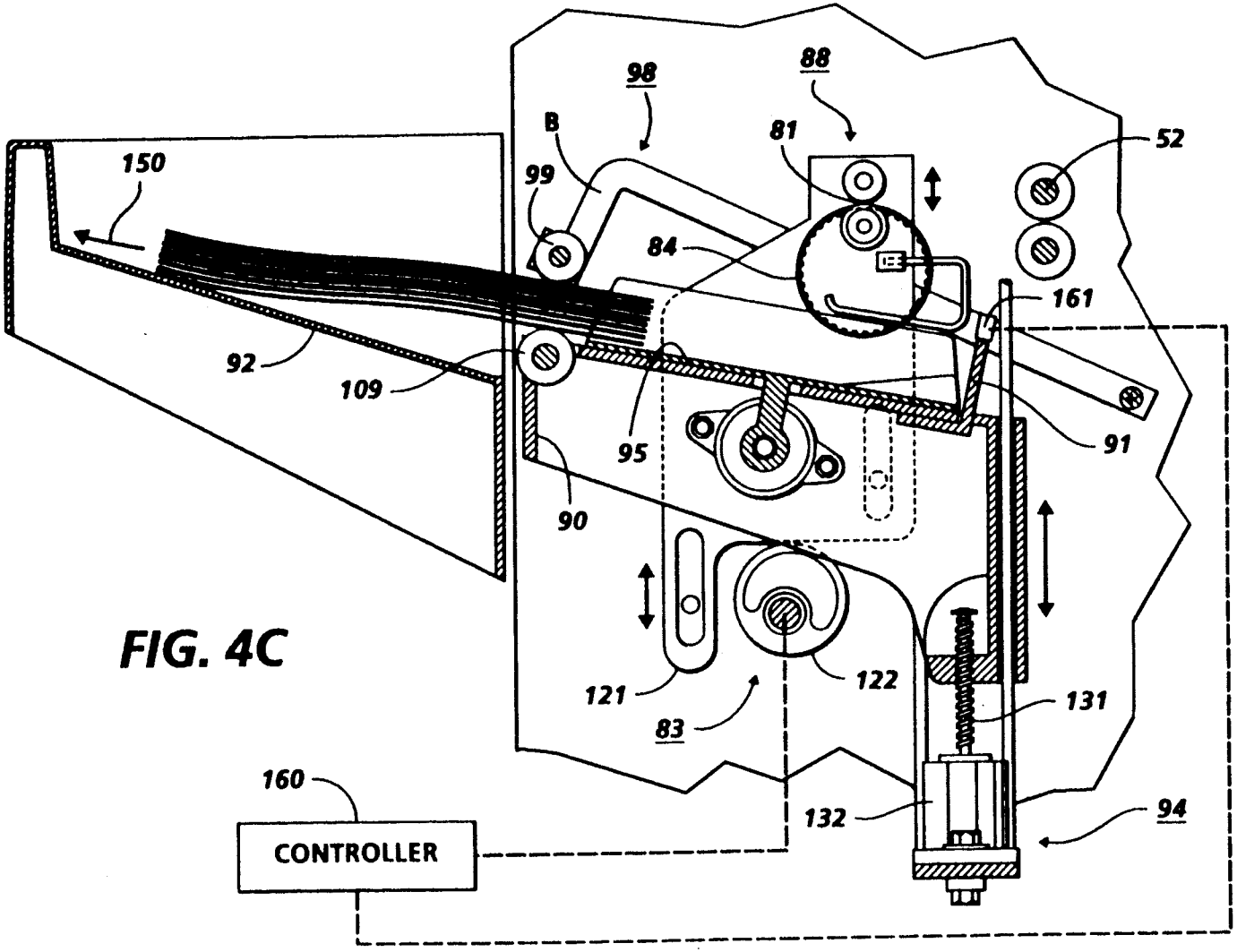
Figure 5:
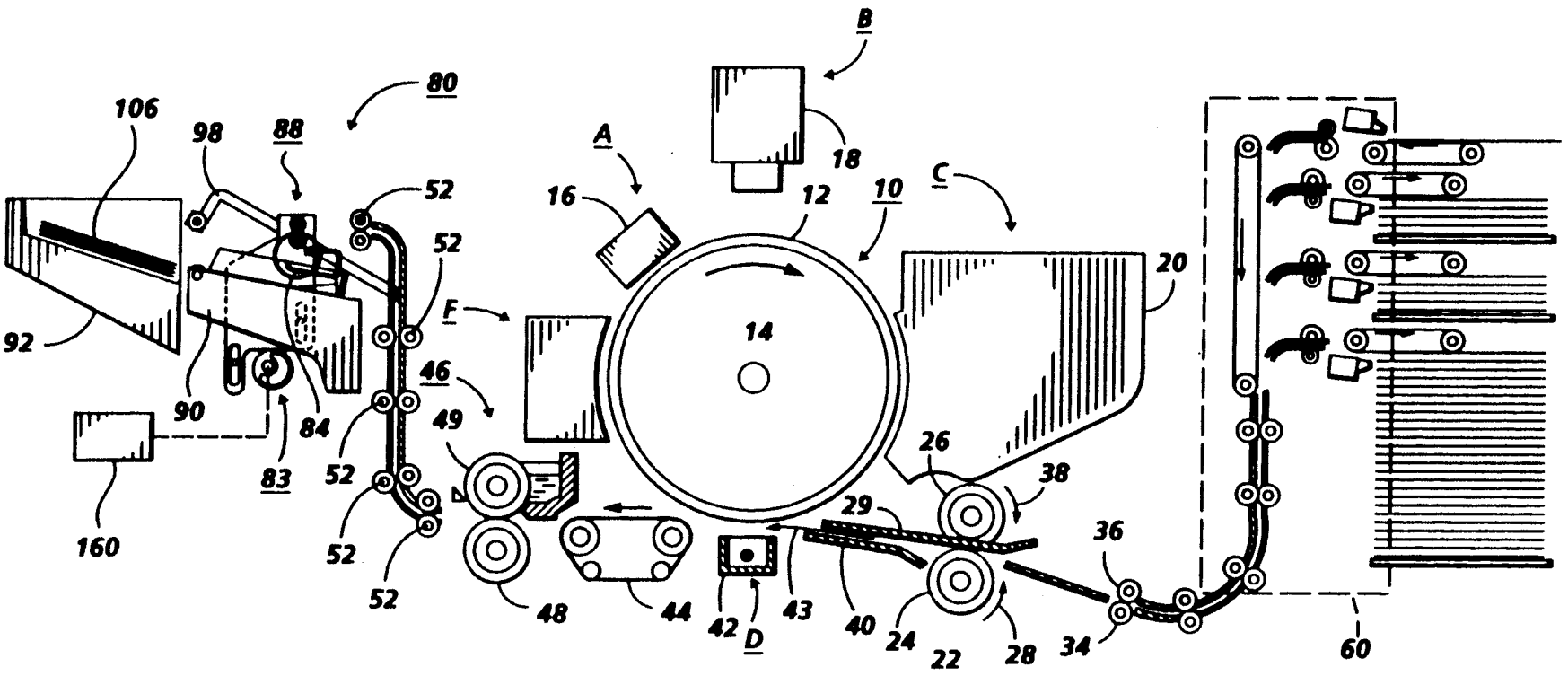

FIGS. 4A, 4B, and 4C are front elevational views depicting an illustrative cycle of the compiling apparatus; and FIG. 5 is a schematic elevational view depicting an illustrative electrophotographic printing machine incorporating the sheet compiling apparatus of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of an electrophotographic printing machine in which the features of the present invention may be incorporated, reference is first made to FIG. 5 which depicts schematically the various components thereof. Hereinafter, like reference numerals will be employed throughout to designate identical elements. Although the apparatus for compiling sheets is particularly well adapted for use in the electrophotographic printing machine of FIG. 5, it should become evident from the following discussion that it is equally well suited for use in a wide variety of machines and is not necessarily limited in this application to the particular embodiment shown herein.

Since the practice of electrophotographic printing is well known in the art, the various processing stations for producing a copy of an original document are represented in FIG. 5 schematically. Each processing station will be briefly described hereinafter.

As in all electrophotographic printing machines of the type illustrated, a drum 10 having a photoconductive surface 12 secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high, substantially uniform potential.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 5, a copy sheet is advanced by sheet feeding apparatus 60 through the paper path which includes drive rolls 34 and 36 to registration roller 24 and idler roller 26. Registration roller 24 is driven by a motor (not shown) in the direction of arrow 28 and idler roller 26 rotates in the direction of arrow 38 since roller 26 is in contact therewith. In operation, feed device 60 operates to advance the copy sheet from the tray through the guide and along the path which rolls 34 and 36 are located and then into registration roller pairs 24, 26 and 25, 27 such that the sheet is forwarded toward the drum 12 in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet. After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 49 and a backup roll 48 defining a nip therebetween through which the copy sheet passes. After the fusing process is completed, the copy sheet is advanced by the discharge roller pairs 52, which may be of the same type as registration rollers 24 and 26, to the compiling apparatus of the present invention generally indicated by the reference numeral 80.

With continued reference to FIG. 5, the compiling apparatus includes generally, a sheet discharge device, usually in the form of a drive nip assembly, indicated generally by the reference numeral 88, which includes the exit drive rolls 86, 87 and the longitudinal registration belts 84; a compiling tray 90; a vertical adjustment device 83 for the discharge drive nip assembly 88; a compiled set discharge device 98; and a stacking tray 92 for receipt of the finished attached sheet sets 106. Compiling apparatus 80 will be described hereinafter in greater detail with reference to FIG. 1 through FIG. 4C, inclusive.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIGS. 1, 2, 3 and 4A, 4B, and 4C depict the sheet compiling apparatus in greater detail.

Figure 1:
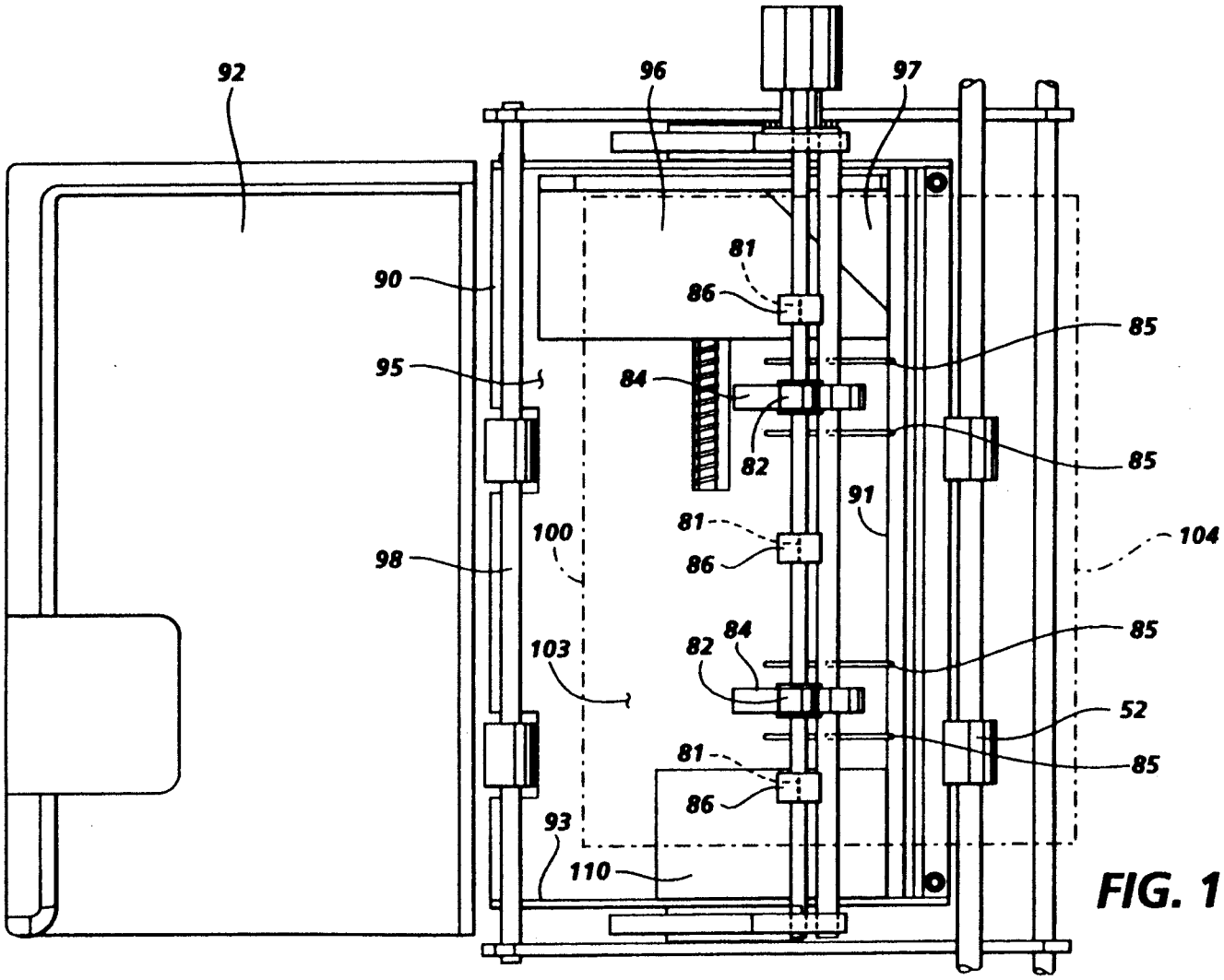
FIG. 1 is a plan view of the compiling apparatus of the present invention.
Figure 2A:
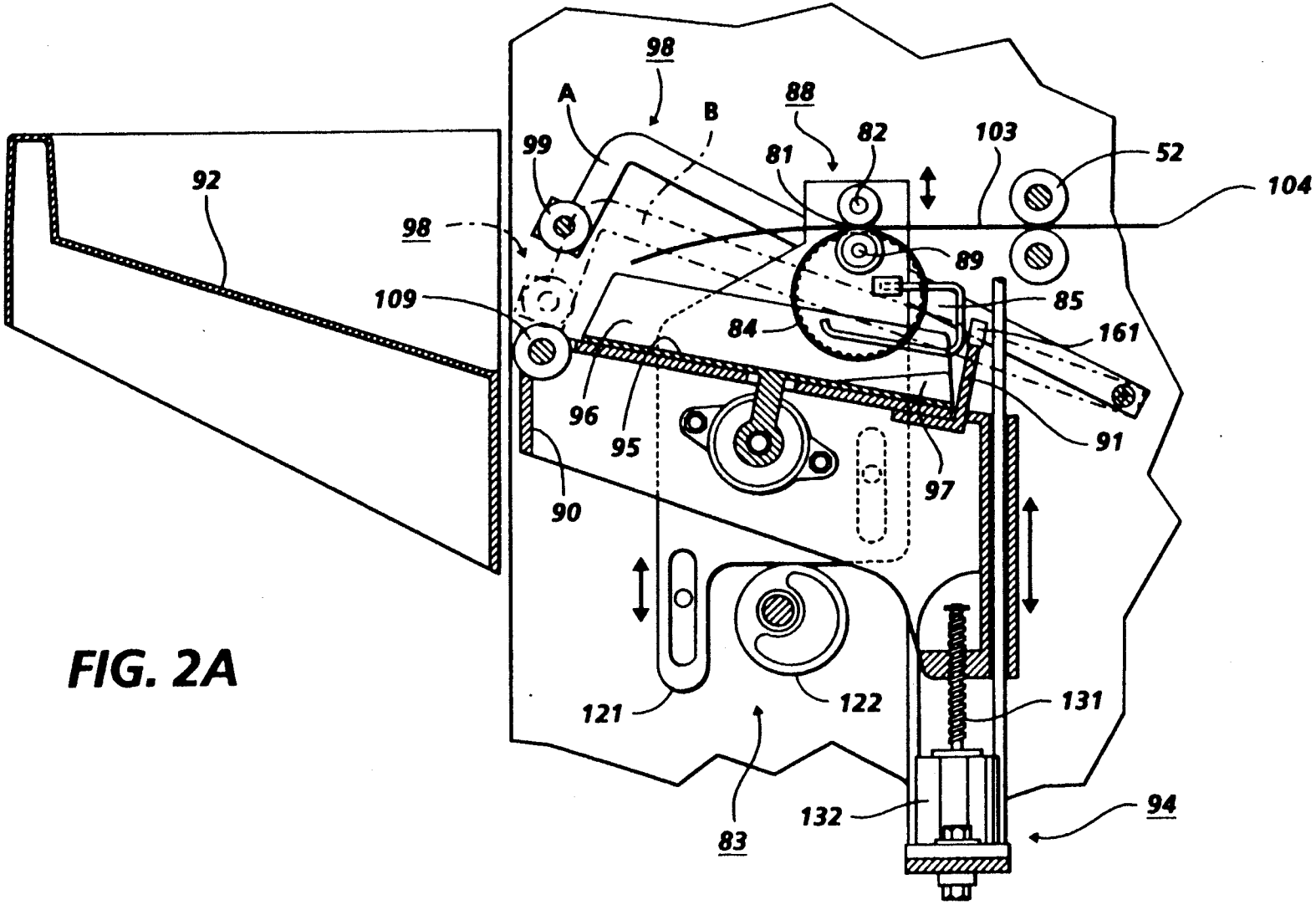
FIGS. 2A and 2B are front elevational views of the FIG. 1 compiling apparatus depicting sheet discharge.
Figure 2B:
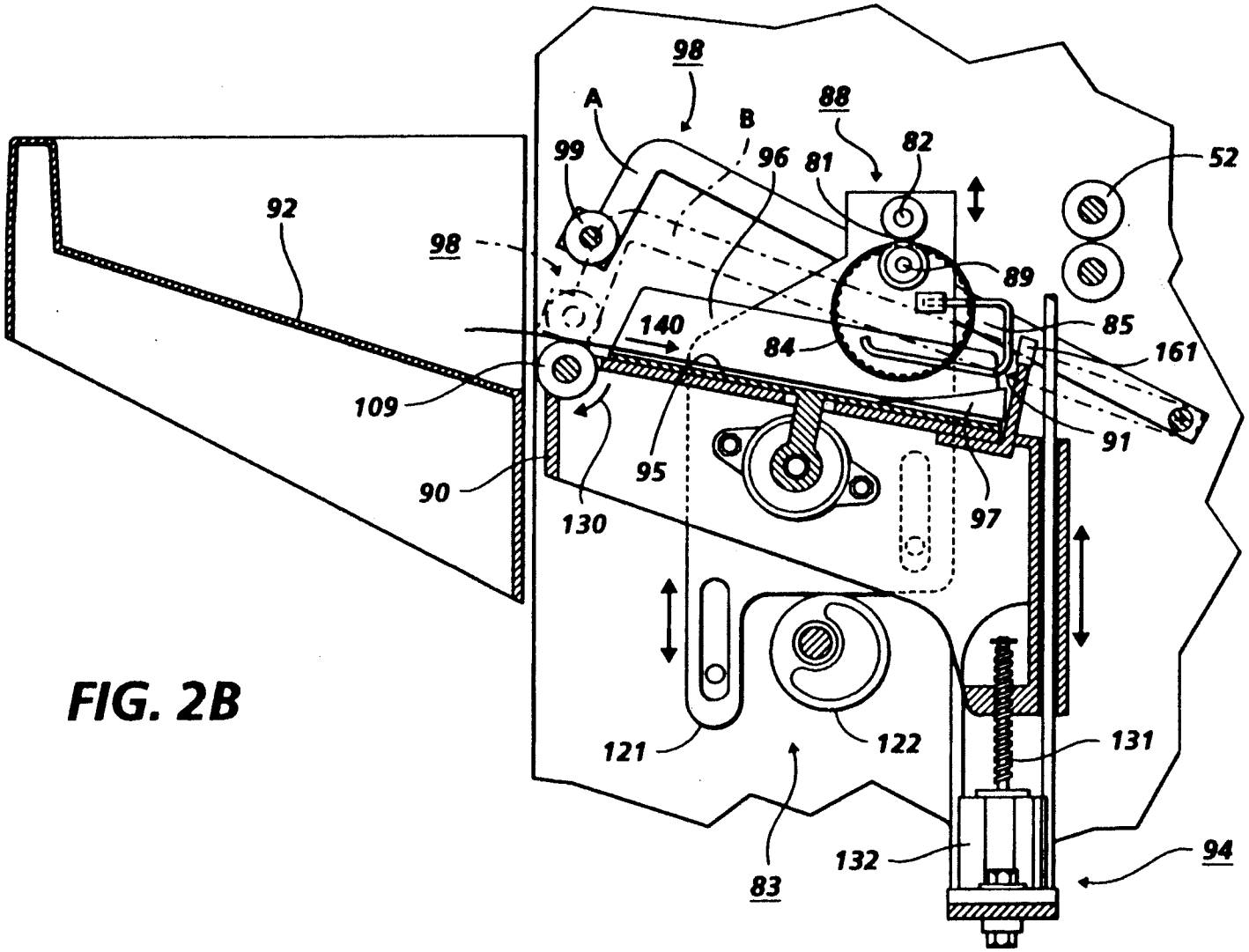
Figure 3:
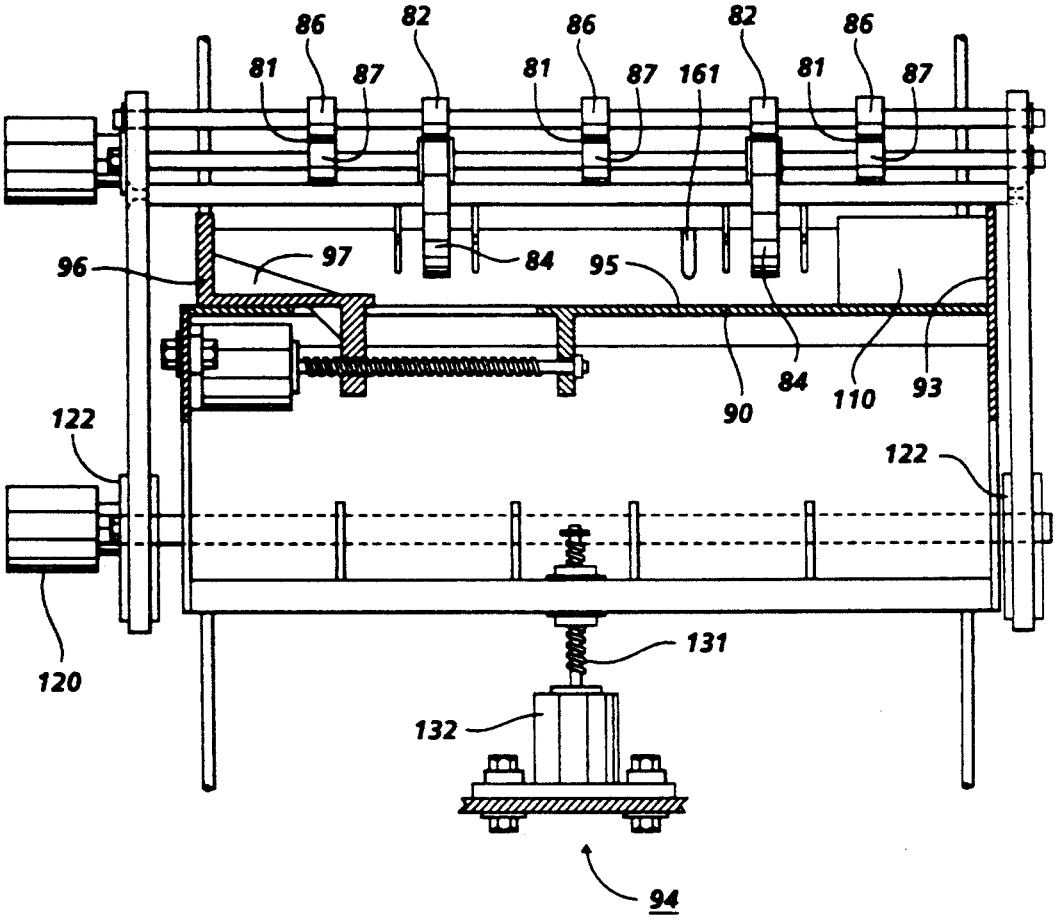
FIG. 3 is a side elevational view showing the compiling tray of the FIG. 1 compiling apparatus.

FIG. 1 and FIG. 3 illustrate the relationship between the discharge roller pairs 52, exit drive rolls 86, 87, the longitudinal registration belts 84, the lateral registration tamper 96, the compiling tray 90 and the discharge stacking tray 92. A sheet is transported from the fusing station E (FIG. 5) by the discharge roller pairs 52 until it is acquired by the exit drive rolls 86, 87. The discharged sheet 100 exits the discharge drive nips 81 (more clearly seen in FIG. 3) of the exit drive rolls 86, 87 and falls into the inclined compiling tray 90. The upper, outer circumference of the longitudinal belts 84 can also act as the discharge drive mechanism. Due to the inclination of the compiling tray 90, which is nominally 25° to 30°, the sheet 100 begins to fall back towards the discharge end of the machine. The set discharge roll 109 in the bottom of the compiling tray 90 (as seen in FIGS. 2A and 2B) can be reversed at this time to assist in the longitudinal registration of the first sheet in each set. The longitudinal registration belts 84 contact the top face 103 of the sheet and cause the trail edge 104 of the sheet 100 to be aligned against and abut the rear wall 91 of the compiling tray 90, which is adjacent to the discharge end of the machine (see FIG. 2B). At that point, the lateral registration tamper 96 pushes each of the sheets to the lateral registration edge 93 of the compiling tray 90. The tamper 96 is controlled by the machine controller based upon the type and size of copy sheets being utilized. The lateral tamper 96 is provided with a flared foot 97 or baffle so as to prevent the deformation of the sheets which inhibits lateral registration. The baffle 97 prevents the sheets from buckling due to the corrugation of the sheets and resulting increase in beam strength caused by the upturned baffle 97. The sheets continue to be discharged and longitudinally registered by the belts 84, and laterally registered by the tamper 96 until the complete set 106 (as seen in FIG. 4B) resides in the compiling tray. Once the registration is complete, the sheets of the set can be attached to one another by means of a stapler 110 or any other suitable binding device. After stapling, the set discharge device 98 discharges the set 106(as seen in FIG. 4C) into the stacking tray 92.

With reference to FIGS. 2A and 2B, the exit drive nip assembly adjustor 83 and the tray adjustor 94 can be readily seen. The drive nip assembly adjustor 83 illustrated consists of a support plate 121 and a cam 122 driven by a step motor 120 to accurately position the registration belts 84 in relation to the sheets 100 being discharged into the compiling tray 90 based upon stack height feedback or sheet output count as discussed below. The compiling tray can likewise be adjusted in a similar manner, or as shown in the figures, can utilize a screw drive assembly 94 consisting of a screw 131 and drive motor 132 to further increase compiling capacity. The vertical displacement of the drive nip assembly 88 can also be accomplished by a screw device, a rack and pinion device or any other well known vertical displacement device. This adjustment prevents the profile of the path of the longitudinal registration belt 84 from being deformed into a elliptical shape which hinders the efficient operation of the registration belt and may cause damage to the copy sheets. The compiling tray 90 can also be arranged for passive adjustment wherein the tray 90 is supported by a spring or other damping mechanism and caused to pivot about its end furthest from the printing machine discharge resulting in the vertical displacement of the end adjacent to the printing machine due to the weight of the discharged sheets.

The longitudinal registration belt is partially entrained about and driven by pulley 89 and held in place by idler 82. The paper curl guards 85 can also be seen in FIGS. 2A and 2B. These guards 85 help to prevent an up-curled trailing edge of a sheet from riding up and failing to fully register against the rear wall 91. Referring to FIG. 2B, once the sheet 100 has been discharged from the sheet exit rolls 86, 87 and lands into tray 90, the set discharge drive roll 109 is momentarily driven in the reverse direction, indicated by arrow 130. The top surface 103 of the sheet is contacted by the flexible belt 84 causing the sheet to be driven in the direction of arrow 140 until it is registered against the rear wall 91 of the tray 90. The compiled set discharge device 98 can be seen in FIGS. 2A and 2B. In this embodiment the set discharge device 98 is an idler roll 99 and a drive roll 109 but other devices such as belts or mechanical fingers or pushers could be utilized. During the compiling cycle, this discharge device 98 is in an up position as represented by position A and is not in contact with any of the sheets in the compiling tray 90. Once the compiled set is both longitudinally and laterally registered and stapled, the discharge device 98, in this case a set of idler rolls 99, is lowered onto the top surface of the compiled set to form a nip with drive rolls 109 as represented by position B. The compiled, stapled set is driven out of the compiling tray 90 and into the stacking tray 92.

With reference to FIG. 3, the relationship between the longitudinal registration belts 84 and the lateral registration tamper 96 can be seen. Once each sheet is discharged and longitudinally registered by the rotation of the belts 84 against the topmost surface of the sheet in the compiling tray 90, the tamper 96 shifts each sheet to the lateral registration edge 93 of the tray 90. As previously mentioned, the flared foot 97 of the tamper 96 corrugates the sheet thereby increasing the beam strength and allowing for complete registration. Because the longitudinal registration belts 84 are flexible, they are easily deformed in the lateral direction to the extent necessary to prevent damage or scuffing of the completed copy. Additionally, because the exit nip assembly 88 and if desired, the compiling tray 90, are vertically adjustable, the belts 84 are maintained so that the path of the belts as viewed from the front of the machine remain in substantially round profiles and exert only the minimal force necessary to complete longitudinal registration. Once each sheet in the stack is both longitudinally and laterally registered the stack is then attached by means of a stapler 110, stitcher, or some other suitable binding device.

FIGS. 4A, 4B and 4C schematically illustrate an exemplary cycle of the compiling apparatus of the invention herein.

Turning initially to FIG. 4A, the initial position of the drive nip assembly 88, compiling tray 90, compiled set discharge device 98 and the stacking tray 92 can be seen. Initially, the lower circumference of the longitudinal registration belts 84 are in contact with the tray surface 95 of the compiling tray 90. As the sheets 100 are discharged into the compiling tray 90 and registered against the back wall 91 and the side edge 93, the drive nip assembly 88 is vertically adjusted by the machine controller 160 either based on discharged sheet count or in response to feedback from a conventional stack height sensor 161 to maintain a substantially round belt path profile as previously discussed. This round profile maintains only the minimal force necessary for longitudinal registration of each discharged sheet and does not subject the sheets to excess force which would occur were the belt path allowed to deform into an elliptical shape. When utilizing sheet count, the properties of the copy sheets, i.e. weight, thickness, etc., can be determined and utilized by the machine controller to make the vertical adjustments. The stack height sensor 161 detects the stack height and causes vertical adjustment of the drive assembly 88. It is also possible to adjust the vertical position of the compiling tray 90 to provide even greater stack capacity. This vertical movement of the exit nips 81 and compiling tray 90 is depicted in FIG. 4B.

As illustrated in FIG. 4B, as the sheets are compiled and registered against the rear wall 91 and the side edge 93 of the compiling tray 90, the drive assembly 88 and compiling tray are adjusted to maintain the round path of the longitudinal registration belt 84. As is shown in both FIGS. 4A and 4B, during the compiling and registration stage, the compiled set discharge device 98 is in an up and non-contacting position with the compiled sheet stack 104, as represented by position A.

Referring now to FIG. 4C, once the completed set is entirely discharged into the compiling tray 90 through the discharge nip 81, longitudinally registered against the back wall 91 of the compiling tray 90 by the flexible longitudinal registration belts 84, laterally registered by the tamper 96 against the lateral edge 93 (FIG. 3) of the compiling tray 90 and stapled, the compiled set discharge device 98 is lowered into contact (represented by position B) with the compiled, attached set 106. When the device is lowered, a drive nip is created between rolls 99 and 109. The drive roll 109 is then engaged and the set 106 is driven in the direction of arrow 150 into the stacking tray 92 and the discharge device 98 then returns to an up position indicated by position A in FIG. 4A. Alternatively, the drive roll could be in the upper moving portion of the discharge device 98. As previously mentioned, this discharge could also be accomplished by transport belt, mechanical pusher fingers or other suitable transport device. The sheet discharge nip assembly 88 and compiling tray 90 (if adjustable) return to the initial position, as indicated in FIG. 4A, and the apparatus is ready to compile the subsequent sets of copy sheets. Although not illustrated, it is also apparent that the compiling apparatus can be utilized in other applications to process sets of documents.

In recapitulation, there is provided an apparatus for stacking, registering and attaching one or multiple sets of electrophotographic printing machine output. The copy sheets are discharged from the machine into an inclined compiling tray and are longitudinally registered by flexible, endless belts contacting the top surface of each sheet. Each sheet is then laterally shifted by a tamping mechanism which also corrugates the sheet as it is shifted to increase the sheet beam strength and facilitate easier and more complete registration. The discharge nip assembly which includes the flexible belts is vertically adjustable based upon stack height so as to maintain optimum contact by the endless registration belt and allow for high capacity compiling. The compiling tray can also be adjustable. Once a complete set of sheets has been discharged and fully registered, the stack is then attached by stapling or other means and is discharged from the compiling tray. The discharge nip and compiling tray then return to their initial position to accept the next set of copy sheets.

It is, therefore, apparent that there has been provided in accordance with the present invention, a high capacity sheet compiling apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for compiling a plurality of sheets received from a printing machine to form a stack thereof, comprising:

means for acquiring and discharging sheets;

sheet compiling means disposed adjacent to said acquiring and discharging means for receiving sheets from said acquiring and discharging means;

means for lateral registration of each of the received sheets in the stack in said compiling means;

means for determining the stack height in said sheet compiling means; and means, responsive to said height determining means, for moving said acquiring and discharging means relative to said sheet compiling means.

2. An apparatus according to claim 1, wherein said sheet compiling means further includes:

an end registration edge adjacent to said acquiring and discharging means; and a lateral registration edge disposed at an end of said end registration edge at a substantially 90 degree angle.

3. An apparatus according to claim 2, wherein said lateral registration means comprises a laterally movable guide which moves from a first position to a second position for positioning each sheet of the stack against said lateral registration edge as it is received so that the compiled stack of sheets is fully registered, said movable guide includes a vertical member, and an upwardly flared member having an upturned surface with the highest region thereof being adjacent said vertical member.

4. An apparatus according to claim 1, further comprising means, proximately disposed to said sheet compiling means, for longitudinal registration of the sheets received from said acquiring and discharging means.

5. An apparatus according to claim 4, wherein said acquiring and discharging means comprises a first plurality of rotatable driven members and a second plurality of rotatable idler members in frictional contact with said driven members so as to form a sheet discharge drive nip.

6. An apparatus according to claim 1, further comprising means for ejecting a compiled sheet stack from said sheet compiling means.

7. An apparatus according to claim 1, further comprising compiled stack receiving means disposed to receive compiled sheet stacks from said sheet compiling means.

8. An apparatus according to claim 1, wherein said sheet compiling means comprises a vertically adjustable tray inclined so as to oppose the direction of sheet discharge.

9. An apparatus according to claim 1, further comprising:

means disposed adjacent to said sheet compiling means, for attaching the sheets of the stack to one another;

means for ejecting a compiled sheet stack from said sheet compiling means; and compiled stack receiving means disposed to receive compiled sheet stacks from said sheet compiling means.

10. An apparatus for compiling a plurality of sheets received from a printing machine to form a stack thereof, comprising:

means for acquiring and discharging sheets, said acquiring and discharging means comprises a first plurality of rotatable driven members and a second plurality of rotatable idler members in frictional contact with said driven members so as to form a sheet discharge drive nip;

sheet compiling means disposed adjacent to said acquiring and discharging means for receiving sheets from said acquiring and discharging means;

means for determining the stack height in said sheet compiling means;

means, responsive to said height detecting means, for moving said acquiring and discharging means relative to said sheet compiling means; and means, proximately disposed to said sheet compiling means, for longitudinal registration of the sheets received from said acquiring and discharging means, said longitudinal registration means comprising a plurality of members coaxially aligned with said rotatable members and a plurality of endless belts partially entrained around said members with the lower outer circumference of said belts being in frictional contact with the topmost discharged sheet in said compiling means.

11. An apparatus according to claim 10, wherein said longitudinal registration means further comprises a plurality of curl guards disposed parallel to said endless belts at a height substantially equal to but not lower than that of the lower circumference of said endless belts.

12. An apparatus according to claim 10, wherein said sheet compiling means further includes an end registration edge adjacent to said acquiring and discharging means.

13. An apparatus for compiling a plurality of sheets received from a printing machine to form a stack thereof, comprising:

means for acquiring and discharging sheets, said acquiring and discharging means comprises a first plurality of rotatable driven members and a second plurality of rotatable idler members in frictional contact with said driven members so as to form a sheet discharge drive nip;

a vertically adjustable tray, positioned adjacent to said acquiring and discharging means disposed to receive sheets from said acquiring and discharging means, said tray inclined so as to oppose the direction of sheet discharge, wherein said tray further includes an end registration edge adjacent to said acquiring and discharging means;

means for determining the stack height in said tray;

means, responsive to said determining means, for moving said acquiring and discharging means relative to said tray; and means, proximately disposed to said tray, for longitudinal registration of the sheets received from said acquiring and discharging means, said longitudinal registration means comprising a plurality of members coaxially aligned with said rotatable members and a plurality of endless belts partially entrained around said members with the lower outer circumference of said belts being in frictional contact with the topmost discharged sheet in said compiling means.

14. An apparatus according to claim 13, further comprising means for lateral registration of the received sheets in said compiling means.

15. An apparatus according to claim 13, wherein said longitudinal registration means comprises a plurality of curl guards disposed parallel to said belts at a height at least equal to that of said belts.

16. An apparatus for compiling a plurality of sheets received from a printing machine to form a stack thereof, comprising:

means for acquiring and discharging sheets;

sheet compiling means disposed adjacent to said acquiring and discharging means for receiving sheets from said acquiring and discharging means;

means for determining the stack height in said sheet compiling means;

means, responsive to said height detecting means, for moving said acquiring and discharging means relative to said sheet compiling means; and means for lateral registration of each of the received sheets in the stack in said compiling means, wherein said lateral registration means comprises a laterally movable guide for positioning each sheet of the stack against said lateral registration edge so that the compiled stack of sheets is fully registered, wherein said laterally movable guide further comprises a vertical member, and an upwardly flared member wherein said upwardly flared member has an upturned surface which is highest at a point adjacent said vertical member.

17. An apparatus according to claim 16, further comprising:

means, disposed adjacent to said sheet compiling means, for attaching the sheets of the stack to one another;

means for ejecting a compiled sheet stack from said sheet compiling means; and compiled stack receiving means disposed to receive compiled sheet stacks from said sheet compiling means.

18. An apparatus according to claim 17 wherein said ejecting means comprises:

an idler roller located in said compiling means;

a member pivotally mounted adjacent said idler means; and a driven roll mounted on said member, adapted to cooperate with said idler roller to form a drive nip for ejecting a compiled sheet set in response to said member being pivoted toward said compiling means.

* * * * *